United States Patent [19]

Noe

[11] 3,942,327

[45] Mar. 9, 1976

[54] CONTROL SYSTEM FOR EXTERNAL COMBUSTION ENGINE

[75] Inventor: William B. Noe, Concord, Mass.

[73] Assignee: Thermo Electron Corporation, Waltham, Mass.

[22] Filed: Mar. 25, 1974

[21] Appl. No.: 454,507

Related U.S. Application Data

[62] Division of Ser. No. 250,638, May 5, 1972, Pat. No. 3,826,282.

[52] U.S. Cl. ..... 60/665; 122/448 R

[51] Int. Cl.[2] ..... F01K 13/02

[58] Field of Search ..... 60/660, 661, 664, 665, 60/686, 667; 91/364; 122/451.1, 448 R; 137/625

[56] References Cited

UNITED STATES PATENTS

| | | | |
|---|---|---|---|
| 3,545,207 | 12/1970 | Barber et al. | 60/664 X |
| 3,802,189 | 4/1974 | Jenkins, Jr. | 60/665 |

*Primary Examiner*—Martin P. Schwadron
*Assistant Examiner*—H. Burks, Jr.
*Attorney, Agent, or Firm*—James L. Neal

[57] ABSTRACT

An external combustion engine, such as the vapor cycle engine, produces power by the expansion of a working fluid vapor. A vapor generator vaporizes a suitable working fluid which is fed to an expander. The vaporized working fluid expands and is subsequently fed back to the vapor generator. A burner provides energy for the vapor generator. The fuel and air supply for the burner is controlled by a system responsive to operating conditions of the engine. That is, the power input to the vapor generator is correlated by a control system with the demand on the engine. The control system disclosed involves a servomechanism which may suitably respond, for example, to either the working fluid flow rate or the input from an accelerator which commands a change in the working fluid flow rate.

2 Claims, 12 Drawing Figures

CONTROL SYSTEM FOR EXTERNAL COMBUSTION ENGINE

CROSS REFERENCE TO RELATED APPLICATION

This application is a divisional of U.S. patent application Ser. No. 250,638, filed May 5, 1972 for External Combustion Engine and Control Mechanism Therefor in the name of William B. Noe, now issued as U.S. Pat. No. 3,826,282.

SUMMARY OF THE INVENTION

This invention pertains to a system for controlling the admission of fuel and air to a burner for an external combustion engine such as a vapor cycle engine. In a typical engine, a working fluid vaporized in a vapor generator by heat energy from a burner is admitted to an expander and expands to produce work. Thereafter the expanded vapor passes through a condenser to be liquefied and pumped back to the vapor generator for repeating the cycle.

The amount of heat energy produced by the burner must be correlated to the demand on the engine so that the required amount of power will be produced when the power demand is relatively high, and so that the engine will not either overheat or operate inefficiently under conditions of reduced power output requirements.

The proper correlation of the fuel burning rate with the engine output may be achieved by controlling the firing rate as a function of an engine operating condition such as the working fluid flow rate or the magnitude of an accelerator input which commands a change in the engine output. Accordingly, a control system is provided which derives signals functionally related to the selected engine operating conditions and, in accordance therewith, adjusts devices for varying the admission of fuel and air to the burner. A feedback signal to the control system may be provided so that the control system output will be constantly monitored by the input.

The control mechanism may comprise a servo-valve having ports to a relatively high pressure fluid supply, a fluid responsive valve means for controlling admission of a combustible mixture to the burner and a relatively low pressure fluid reservoir. The servo-valve controls fluid communication between the ports in accordance with the character of the combustible mixture to be admitted to the burner means. When increased burner output is required, communication will be established between the supply port and the fluid pressure responsive valve means so that the relatively high pressure of the fluid supply port is applied to the valve means to increase flow. When reduced burner output is desired, fluid communication is established between the fluid responsive valve and the reservoir so that the relatively low pressure of the reservoir is applied to the valve.

DETAILED DESCRIPTION OF THE DRAWINGS

Figure 1:
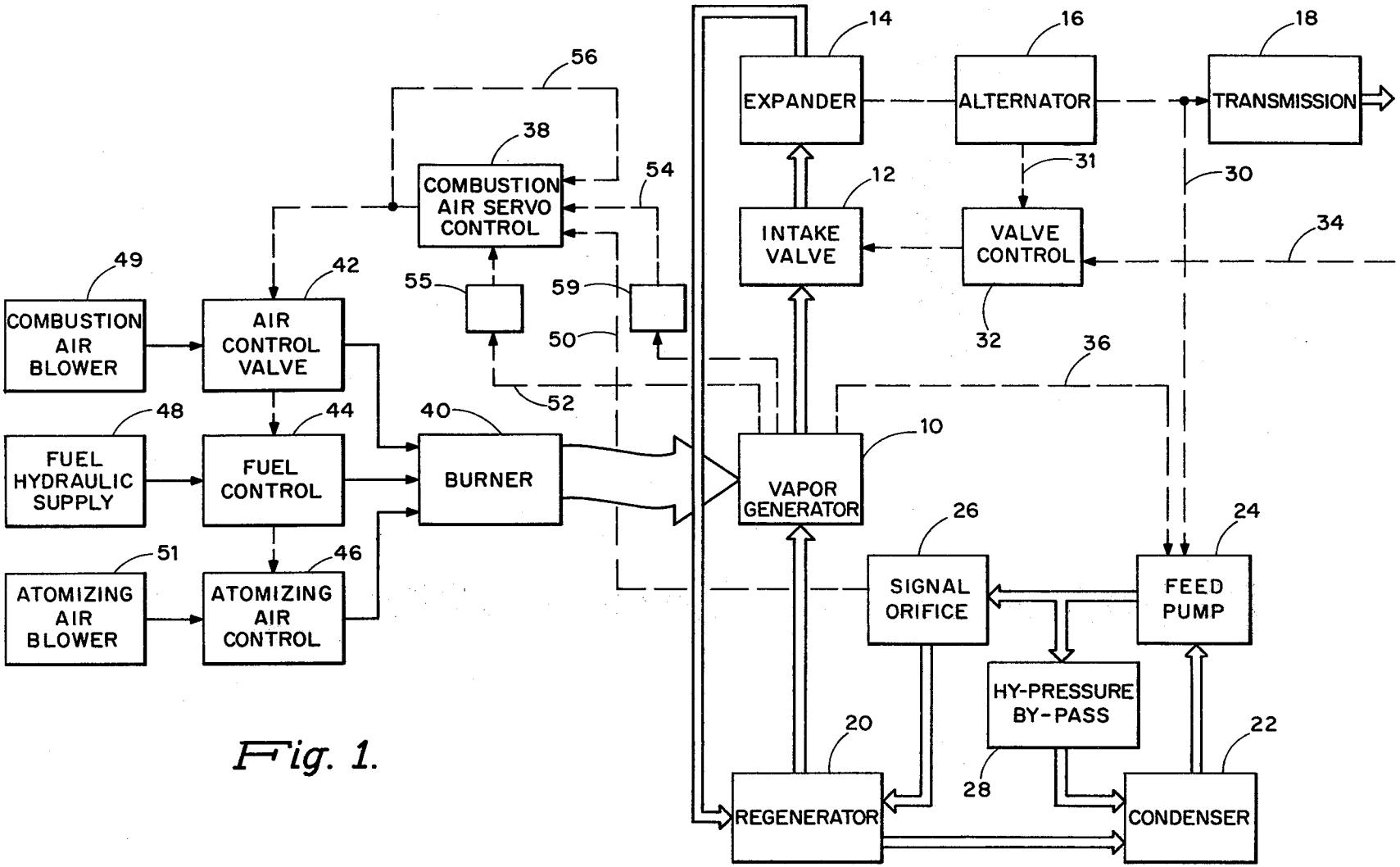
FIG. 1 is a block diagram showing one embodiment of a vapor cycle engine constructed in accordance with this invention.

Reference will now be made to FIG. 1. A vapor generator 10 evaporates any suitable working fluid such as trifluoroethanol, thiophene, pyridine or water, which is admitted through an intake control valve 12 to an expander 14. Work produced by the expanded fluid may drive an alternator 16 and an appropriate driven device such as a transmission 18. Expanded working fluid passes from the expander 14 through the vapor side of the regenerator 20, to a condenser 22. A feedpump 24 drives the condensed working fluid from the condenser, through a signal orifice 26 and the liquid side of the regenerator 20, back to the vapor generator 10. A high pressure bypass 28 provided between the feedpump 24 and the signal orifice 26 permits working fluid to pass from the feedpump directly back to the condenser 22 in the event of excessive feedpump output. The feedpump means 24 is driven directly to the shaft input to the transmission, as indicated at 30. The output of the feedpump 24 is variable as a function of a vapor generator discharge pressure signal 36.

The valve control means 32 is responsive to an electrical signal 31 from the alternator 16 and determines the extent to which the intake valve 12 is opened. The valve control may also have an additional input 34 which may, for example, be from an accelerator which provides a signal source to command a change in the working fluid flow rate when a change in the power output rate is desired. The intake valve control mechanism is described in more detail in U.S. patent application Ser. No. 215,838, filed Jan. 6, 1972, now U.S. Pat. No. 3,748,966, entitled "Vapor Engine Speed Control" and assigned to the assignee of the present invention. It will be understood, however, that the particular means described to control the admission of working fluid vapor to the expander is by way of example and that any suitable means may be used.

It will be apparent that an increased power output of the engine requires an increased flow of working fluid and that the flow of working fluid is decreased to reduce the power output level. Accordingly, the heat input to the vapor generator 10 is varied in accordance with the desired power output. This is achieved by providing a servo-mechanism 38 responsive to various engine operating conditions for controlling the fuel and air mixture admitted to a burner 40 which supplies the heat energy to the vapor generator 10. The servomechanism 38 controls the fuel and air mixture by controlling the operation of an air control valve 42, a fuel control 44 and an atomizing air control 46. The fuel control 44 determines the amount of fuel fed to the burner from a fuel supply 48. The air control valve 42 controls the amount of air mixed with the fuel to make a combustible mixture and the atomizing air control 46 provides air for atomizing the fuel when it is admitted to the combustion chamber.

The servo-mechanism 38 operates as a function of working fluid flow rate and vapor generator temperature. The transient input to the servo-mechanism is derived from the working fluid flow rate. A pressure drop is produced across the signal orifice 26 and differential pressure signals represented as 50' and 50'' provide inputs to the servo-mechanism. The vapor generator temperature provides independent input signals 52 and 54 which, respectively, provide a signal to modify the working fluid flow rate signal and a signal for safety control. The feedback signal 56 to the servo-mechanism is derived at any convenient point from the servo-mechanism output. The operation of the servomechanism will be more particularly described with reference to FIGS. 3 through 5.

Figure 2:
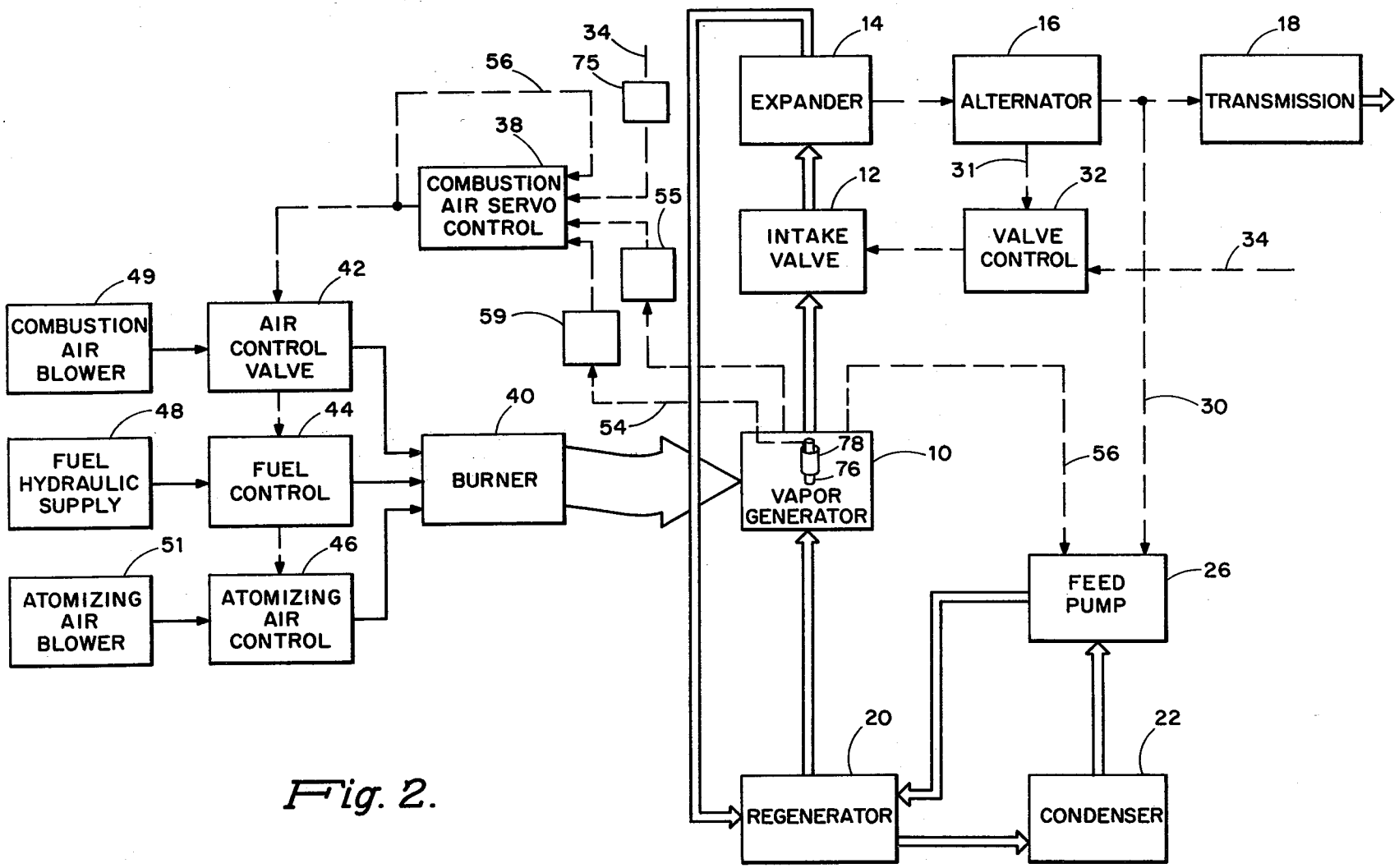
FIG. 2 is a block diagram of another embodiment of a vapor cycle engine constructed in accordance with this invention.

Reference will be made to FIG. 2 wherein there is shown a schematic view of a Rankine cycle engine similar to that shown in FIG. 1. (Like numerals are used to designate like parts.) The primary distinction is that the servomechanism 38 responds directly to an accelerator input rather than to the flow rate of the working fluid. The accelerator displacement provides an input for a mechanical-to-pneumatic transducer 75. The transducer 75 provides a fluid pressure signal to the servomechanism 38 and produces an effect analogous to that produced by the pressure drop occurring across the signal orifice 26 of the engine shown in FIG. 1. The accelerator also provides an input 34 to the valve control 32 as in the engine of FIG. 1. Further, there is schematically illustrated a vapor generator of the type disclosed in U.S. Pat. No. 3,477,412 which was issued Nov. 11, 1969 to the assignee of this invention. This vapor generator includes a tube 76 for conducting working fluid through the vapor generator and a concentric tube 78 forming a jacket surrounding the tube 76. The jacket 78 contains a buffer fluid for evenly distributing heat from the burner 40 to all parts of the tube 76 to avoid hot spots, in a manner fully described in the aforesaid patent. The buffer fluid within the jacket 78 provides a particularly favorable locus for obtaining a signal proportional to the wall temperature of the tube 76. Accordingly, this input to the servomechanism 38 may be obtained by extending a temperature-sensing device into the buffer fluid and transmitting the signal resulting therefrom to a transducer 59 and thence to the servomechanism 38.

Figure 3:
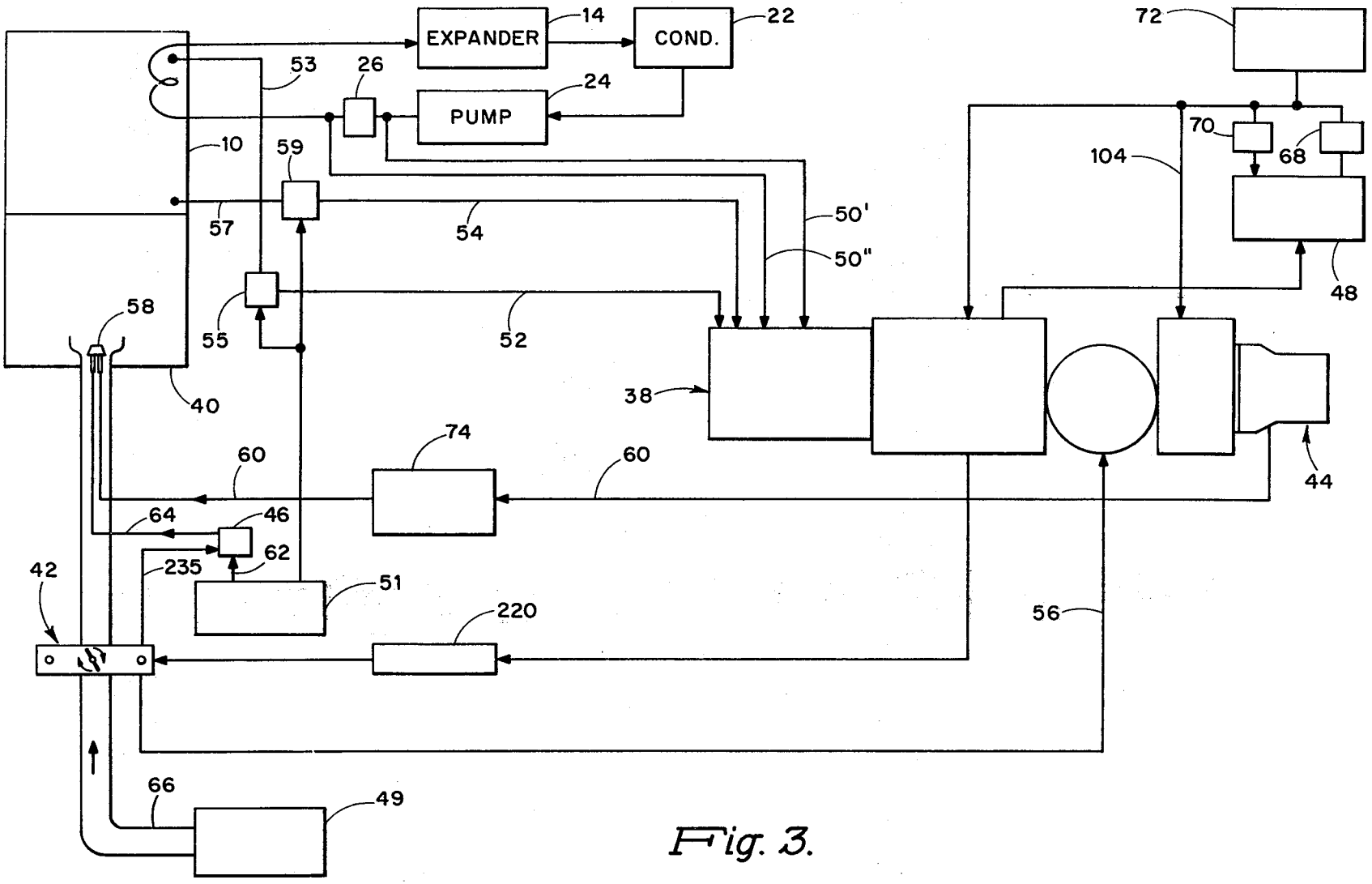
FIG. 3 is a schematic view showing an embodiment of the control system of the present invention corresponding to that shown in FIG. 1.

Reference will now be made to FIG. 3 which shows a schematic diagram of an engine constructed according to the emboidment of FIG. 1. (Like numerals are used to designate like parts.) The vapor generator 10 is associated with burner 40, an expander 14, a condenser 22 and a pump 24. Between the pump 24 and the vapor generator 10 is located the signal orifice 26. From the high pressure side of the signal orifice 26, a high pressure signal 50' is admitted to the servomechanism 38 and, from the low pressure side of the signal orifice, a low pressure signal 50'' provides another input to the servomechanism. The servomechanism is also responsive to the transient and limiting temperature signals 52 and 54 from the vapor generator 10. The output from the servomechanism 38 controls the air control valve 42 to determine the amount of air admitted to the burner 40 from the combustion air blower 49 for producing a combustible air and fuel mixture in the burner 40. The air control valve 42 provides a feedback 56 to the servovalve 38 and an input to the fuel control 44.

The burner 40 includes a fuel inlet nozzle 58 through which fuel is admitted to the burner through a line 60 from the fuel control 44. The fuel discharge through the nozzle 58 is atomized by air supplied from the blower 51 and modulated by the atomizing air control 46. The modulating input to the air control 46 is a function of the setting of the air control valve 42, as indicated at 235. The atomizing air control 46 may be an electro-mechanical valve wherein the position of the valve 42 determines the output of the potentiometer 234 which controls the volume of air passing from the blower 51 to the nozzle 58.

Associated with the fuel control 44 and the fuel supply, or reservoir, 48 is a pump 68 for pumping fuel at an elevated pressure from the reservoir 48 to the control 44. There is provided a pressure regulator 70 with a feedback to the supply 48 and an expansion chamber 72 to insure a constant fuel supply to the control 44. The control 44 admits a carefully controlled volume of fuel through the lines 60 to the nozzle 58. The element 74 limits the maximum fuel flow to the burner 40.

Figure 4:
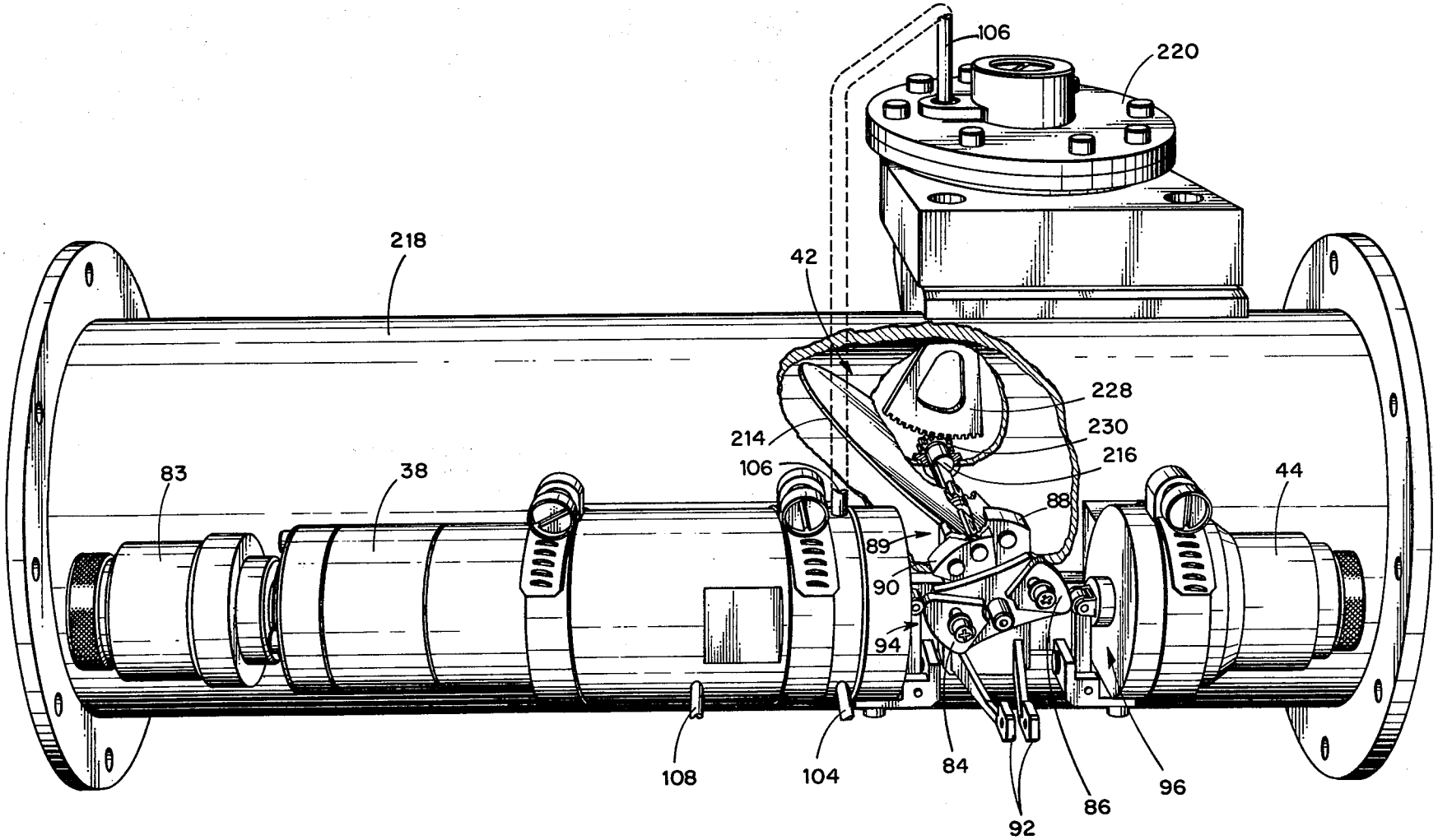
FIG. 4 is a perspective view showing one embodiment of the control system of this invention.

FIG. 4 shows a preferred assembly of the servomechanism 38, the fuel control 44, the air control valve means 42, and a pneumatic-to-mechanical transducer 220. A gear sector 228 and a gear 230 transmit motion from the transducer 220 to a butterfly valve 214 forming part of the valve means 42. Cams 84 and 86 move in response to movement of the butterfly valve 214 and, respectively, provide a feedback signal to the servomechanism 38 and a variable input to the fuel control 44. Cam follower means 94 and 96 associated with the servomechanism 38 and the fuel control 44 cooperate with cams 84 and 86.

A fixed element 88 and an element 90 movable with the butterfly valve 214 cooperate to provide a visual indication of the butterfly valve position. Members 92 are supports for the atomizing air control 46 shown in FIG. 7. The element 83 at one end of the servomechanism 38 is a transducer for giving a signal responsive to the position of the cam follower 94. It may be of any convenient type, such as well known mechanical-to-electrical or mechanical-to-pneumatic devices. The output of the transducer 83 may serve either a control or an indicating function. The servomechanism 38 and the fuel control 44 will be fully described in connection with FIGS. 5 and 6.

Figure 5:
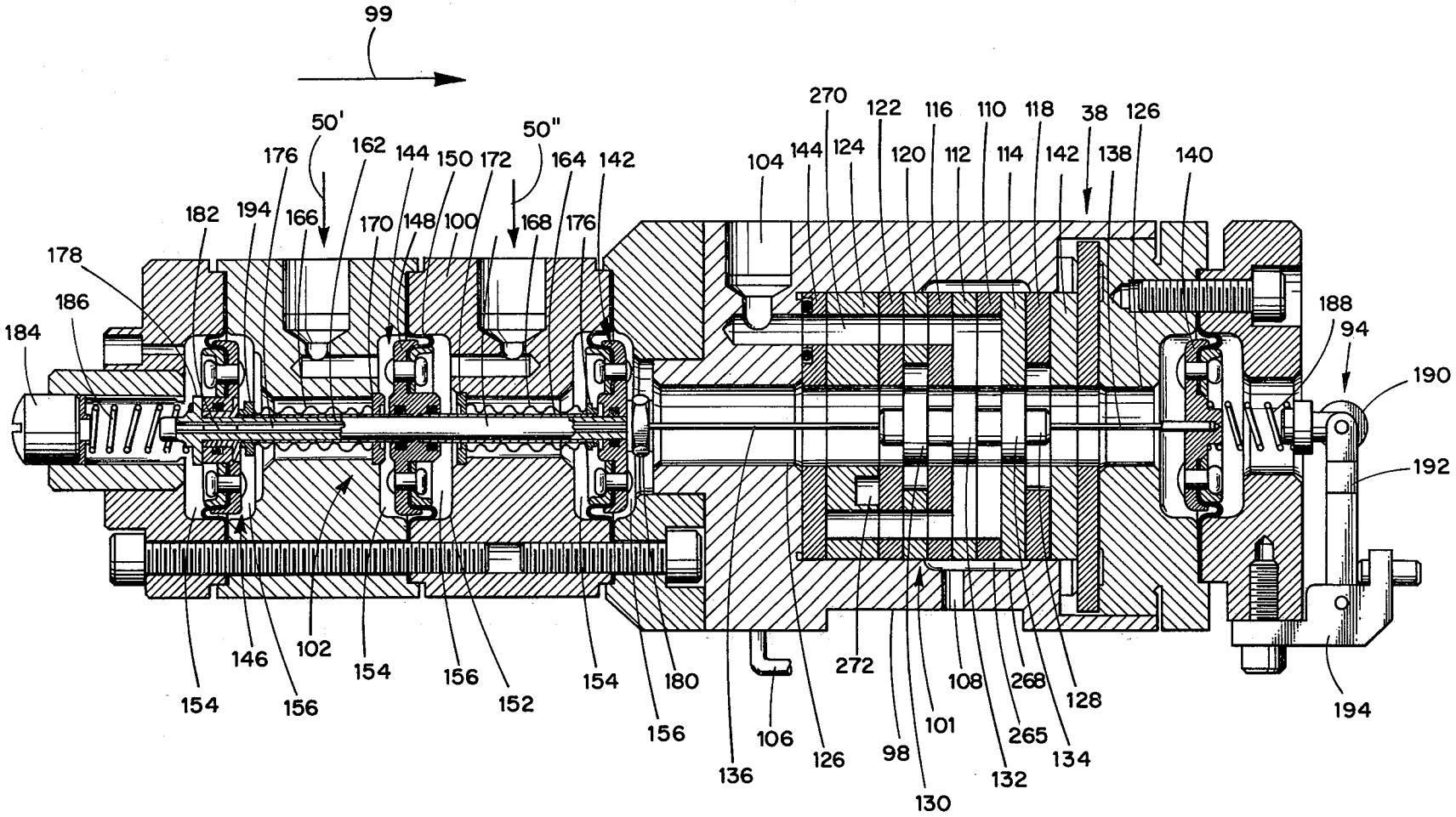
FIG. 5 is a sectional view showing a component of the apparatus of FIG. 4.

The servomechanism 38, as shown in FIG. 5, includes a first housing section 98 and a second housing section 100. The housing section 98 includes a ported servovalve 101 and the housing section 100 includes an operator means 102 for the servovalve. The servovalve 101 communicates with a supply passage 104, a control passage 106 and a reservoir passage 108 which communicate, respectively, with the outlet of the fuel pump 68, the pneumatic-to-mechanical transducer 220 and the fuel supply tank 48. Fluid conducting plates 110 through 124, having fluid conducting ports formed therein, are stacked in face-to-face relationship so that the individual plates communicate in a cooperative fashion which will be described in detail in connection with FIG. 9. However, for purposes of the present discussion, it suffices to observe that two supply plates, 110 and 112, are placed in face to face, contiguous relationship with each other and communicate with the supply passage 104. Outwardly of the supply plates are a pair of control plates 114 and 116 having passages which communicate with the control passage 106. Outwardly of the control plates are a pair of reservoir plates 118 and 120 communicating with the reservoir passage 108. Contiguous to the reservoir plate 120 is a spacer plate 122 and adjacent to the spacer plate is a collector plate 124. A cylindrical bore 126 is formed through all of the plates and the ports within each of the plates 110 through 120 communicate with the cavity formed by the cylindrical bore 126. Within the cylindrical bore is a spool 128 forming three annular lands 130, 132 and 134. Extending from opposite ends of the spool 128 are mounting rods 136 and 138. The mounting rod 138 is supported by a mounting diaphragm 140 and the mounting rod 136 is fastened to a threaded member 182 associated with the operator means 102. Suitable supports along the lengths of rods 136 and 138 may be provided, if necessary. The diaphragm means 140 and 142 are each provided with fluid seals which prevent the loss of fluid from the cylindrical bore 126. The spool 128 is positioned so that, when in neutral position, the lands, 130, 132 and 134 are aligned respectively with the reservoir disc 120, supply disc 112 and control disc 114. In the neutral position, the lands prevent fluid communication between the fluid supply passage 104, the reservoir passage 108 and the control passage 106. Movement of the spool 128 in the direction of the arrow 99 will permit fluid to pass from the supply passage 104 to the control passage 106 and movement of the spool 128 in the opposite direction permits flow of fluid from the control passage 106 to the reservoir passage 108.

The operator means 102 incorporates the sealing diaphragm 142 and further includes diaphragm means 144 and 146, the diaphragm means 146 also constituting a sealing diaphragm between the operator means 102 and the environment. Each of the diaphragms includes a rigid portion 148 and a flexible member 150 which divide a cavity 152 into first and second pressure chambers 154 and 156, respectively. Each of the pressure chambers forms a signal input area; the servovalve 101 responds in its movements to pressure difference across each of the diaphragm means 142, 144 and 146. The pressure chamber 154 for the diaphragm means 146 is exposed to the surrounding environment and the chamber 156 receives the temperature signals 52 and 54. Chambers 154 and 156 of the diaphragm means 144 receive the pressure differential signals 50′ and 50″. Chamber 156 of the diaphragm means 142 faces the bore 126.

It will be understood that the operator means 102 will accommodate any signal inputs delivered to it. For example, if the engine system of FIG. 2 is utilized rather than that of FIG. 1, the accelerator input is direct to the operator means 102. This input may be a pressure which increases as a function of accelerator position and is fed to the pressure chamber 154 of the diaphragm means 144 so that it acts essentially as the signal 50′. The chamber 156 on the opposite side of the diaphragm means 144 is thus free to receive another signal, or it may be exposed to the environmental pressure and serve as a reference to the input signal from the accelerator. It will further be noted that no signal has been described which serves as an input to the chamber 154 of the diaphragm 142. This chamber may be left unused or it stands ready to receive any other appropriate signal which may be applied thereto. Further, the number of diaphragms may be reduced or increased or the character or the operator means 102 may be changed entirely depending upon the number and character of the functions to which the servovalve 101 must respond.

The diaphragm means 142, 144 and 146 are associated with an assembly including a centershaft 160, sleeves 162 and 164 and bellows sealing means 166 and 168. The bellows sealing means 166 and 168 include, respectively, relatively large end caps 170 and 172 and relatively small end caps 174 and 176. The bellows seal 168 prevents communication between pressure chamber 154 of diaphragm means 142 and pressure chamber 156 of diaphragm 144. The bellows seal 166 similarly prevents communication between pressure chamber 154 of the diaphragm means 144 and the pressure chamber 156 of the diaphragm means 146. This is accomplished by sealing one end cap on each bellows seal to the sleeve 162 or 164 with which it is associated and sealing the other end cap to the housing body 100.

The shell 162 extends between diaphragm means 146 and 144 and the shell 164 extends between diaphragm means 142 and 144. These shells space the diaphragms means apart so that they may be held in rigid assembly. The rigid assembly is established by a centershaft 160 which extends through the shells and includes an enlarged end 178 engageable with the diaphragm means 146 and a nut 180 engageable with the diaphragm means 142.

Mounted within the centershaft 160 is the threaded member 182 connected to the mounting rod 136. In this manner the operator means 102 is rigidly connected to the servovalve 101 so that movement of the operator means is transferred to the servovalve. The threaded member is sealed within the centershaft 160 by tight fit or by an appropriate sealing dope or by any other convenient means. Optionally, the open end of the centershaft may be sealed by a plug or the like. However, the advantage of sealing by tight fit or with a sealing dope is that it permits the position of the threaded member 182 to be adjusted by means of an instrument inserted through an opening 184 in the end of the housing means 100. Adjustment of the member 182 permits recalibration of the position of the spool 128 with respect to the various plates 110 through 122. From the foregoing, it will be understood that the operator means 102 and the servovalve means 101 act together as a unitary single assembly. For simplicity of description, the transducer 83 shown in FIG. 4 is not illustrated in FIG. 5.

Figure 6:
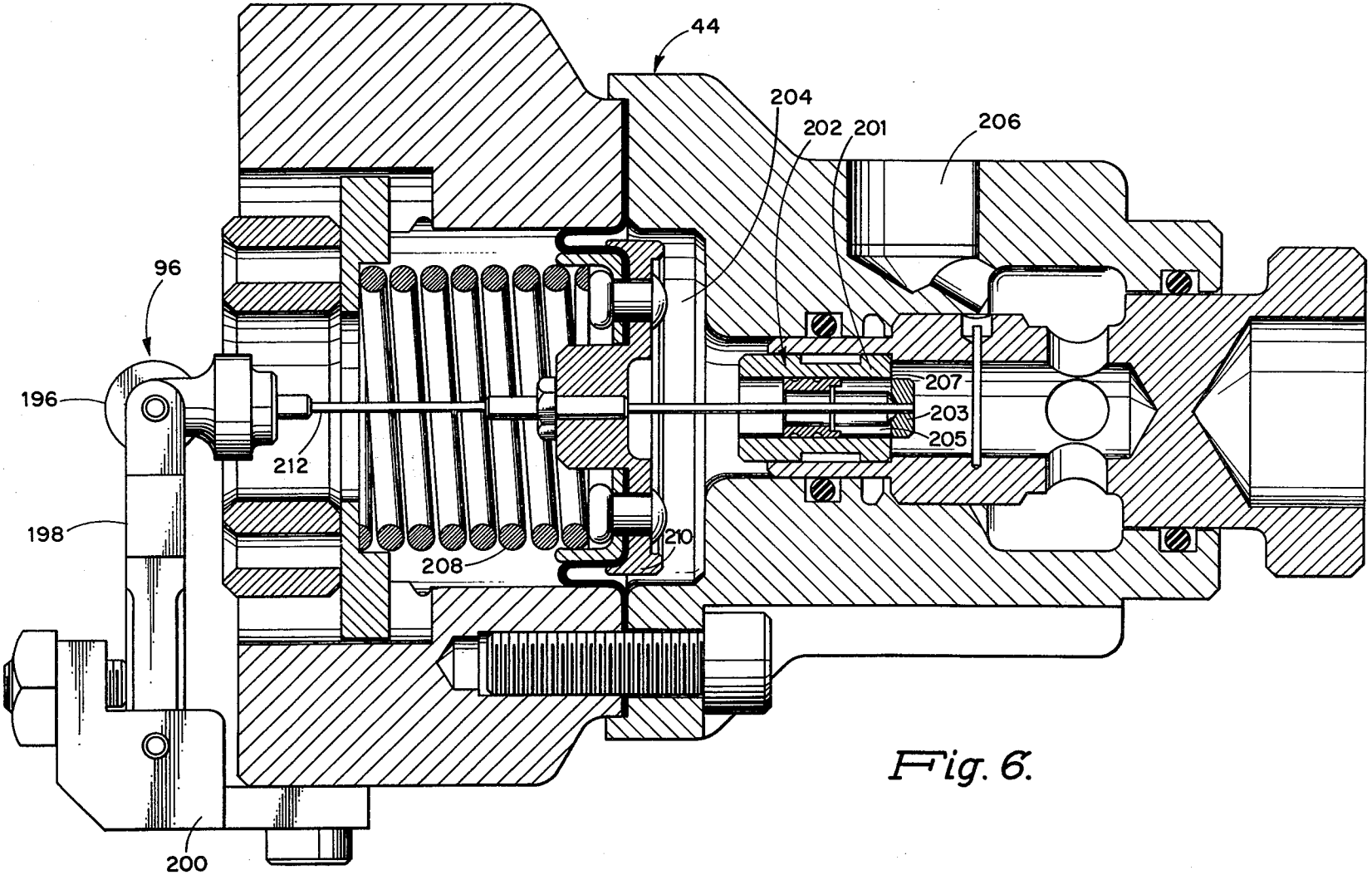
FIG. 6 is a sectional view showing another component of the apparatus of FIG. 4.

Reference is now made to FIG. 6. The fuel control valve means 44 incorporates the cam follower means 96 similar to the cam follower means 94 described in connection with FIG. 5. The cam follower means 96 includes a cam follower 196 supported by an arm 198 pivotally supported by a bracket 200. The position of the cam follower 196 determines the setting of a fuel valve assembly 202 and thereby the volume of fuel supplied from a fuel inlet chamber 204, which communicates with the outlet of the fuel pump 68, through a passage not shown, to a fuel outlet passage 206. The fuel valve assembly includes cooperating fuel metering members 201 and 203 having, respectively, a slot 205 and an edge 207. The fuel valve assembly 202 is shown in its fully closed position and is biased to its fully open position by a spring 208. Bellows sealing means 210 prevents the loss of fuel from the fuel control 44. The pressure of the fuel in the inlet chamber 204 opposes the bias of the spring 208 and serves to bias the fuel valve assembly 202 to its closed position. The bias resulting from fuel pressure in the chamber 204 exceeds the bias of the spring 208 during normal operation so there is a resulting bias urging the following means 96 against the cam 86. The input to the cam follower 196 is transferred along the rod 212 to the fuel valve assembly. An opening force is transmitted to the assembly when the cam 196 is moved toward the fuel valve 202 and movement in the opposite direction results in closing movement of the valve 202. By reference to FIG. 4, it will be seen that the cams 84 and 86 are constructed such that the movements of the cam follower means 94 and 96 are correlated with each other. Admission of fuel through the fuel valve assembly 202 is thus correlated with the volume of air admitted to the combustion chamber under the control of the servovalve means 101 and the operator means 102.

Figures 7, 8:
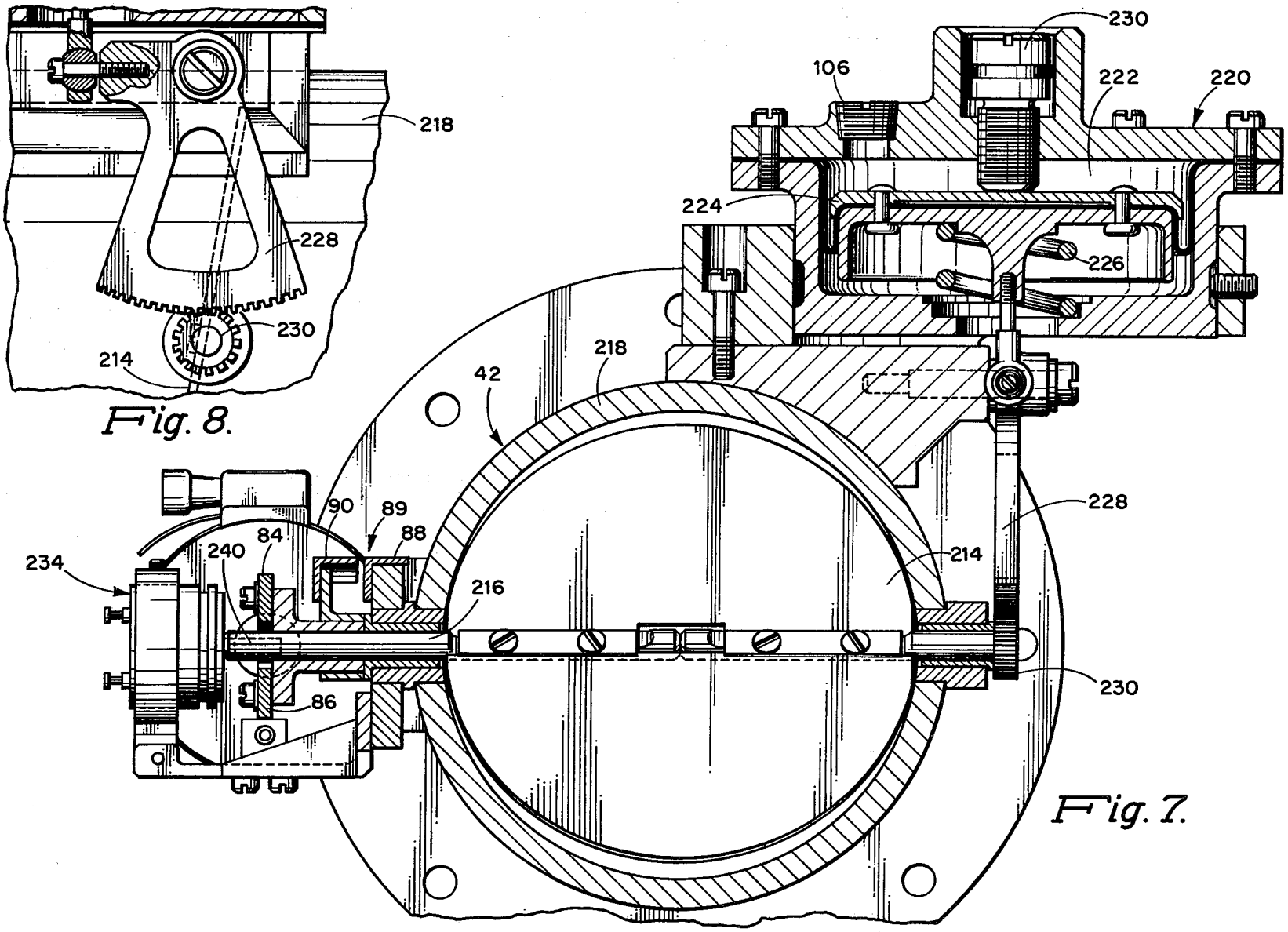
FIG. 7 shows in detail other elements of the apparatus of FIG. 4.
FIG. 8 is a detailed view showing a portion of the apparatus of FIG. 7.

FIGS. 7 and 8 show the valve means 42 for controlling the admission of air to the combustion chamber 40. A butterfly valve 214 mounted on a shaft 216 within the air conduit 218. The position of the butterfly valve 214 is determined by the diaphragm means 220 responsive to the control pressure from the servomechanism 38. The control pressure is transmitted through the control passage 106 which is shown in FIGS. 5 and 7. The diaphragm means 220 defines an expansible chamber 222 which is maintained at the control pressure. The control pressure acts upon a diaphragm 224 in opposition to a biasing spring 226. The diaphragm 224 is linked to a pivoted gear sector 228 which cooperates with a gear 230 to adjust the position of the butterfly valve 214. A stop means 230 limits the movement of the diaphragm means 224 under the influence of the spring 226. A high control pressure produces expansion of the chamber 222 against the bias of the spring 226 and results in an opening movement of the butterfly valve 214. Relatively low pressure in the chamber 222 produces a reduction in the size of the expansible chamber 222 under the influence of the spring 226 so the diaphragm 224 advances toward the stop 230 and the gear sector 228 and gear 230 then cooperate to close the butterfly valve 214. By reference to FIG. 7, it will be noted that the cams 86 and 84 are fixedly mounted with respect to the butterfly valve shaft 216. In this manner, the cam 84 provides a feedback input to the servomechanism 38 and the cam 86 provides a fuel controlling input to the fuel control 44 which are functionally related to the volume of air being admitted to the burner 40 through the conduit 218. Also associated with the shaft 216 is a transducer 234 for providing a control signal for the atomizing air control 46. The transducer 234 is connected to the shaft 216 by a key 240 and provides an output proportional to the shaft position. The transducer may be a potentiometer which produces a variable electrical signal to which the atomizing air control 46 responds. The amount of atomization air is thereby variable proportionally with variation in the volume of fuel and air which are admitted to the combustion chamber 40.

Figure 9:
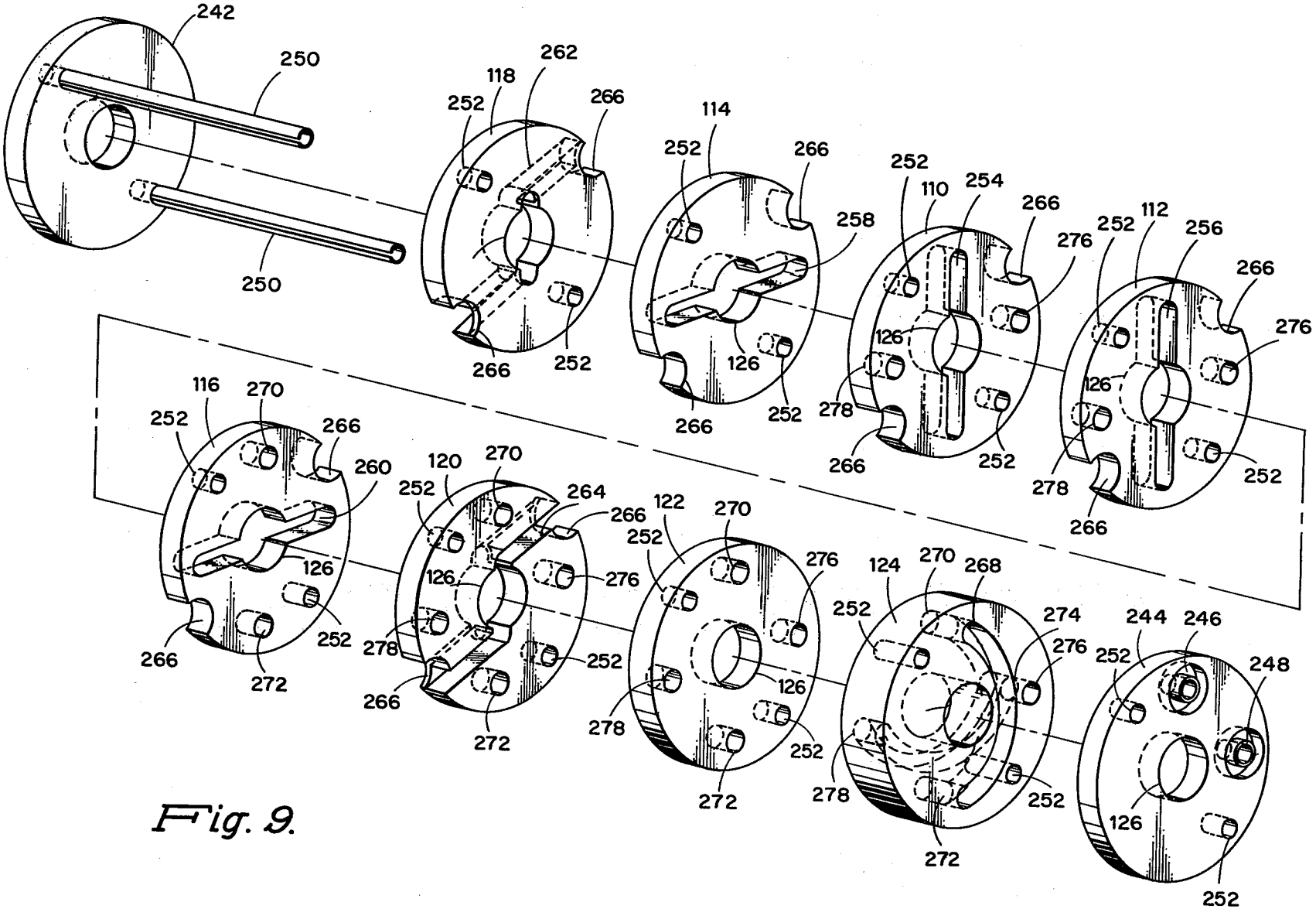
FIG. 9 is an exploded perspective view of certain elements illustrated in FIG. 5.

The particular flow pattern established by the plates 110 through 124 of the servovalve 101 will now be described in connection with FIG. 9. Also associated with the plates is an aligning plate 242 and a sealing plate 244. The plates 242 and 244 serve to hold the other plates in proper alignment and, in addition, the plate 244 includes a supply port 246 and a control port 148. Associated with the plates 242 and 244 are a pair of clamping rods 250 which are generally of a "C" shape. These rods are compressed and passed through the openings 252 in each of the plates. When released, the rods 150 expand and positively hold the plates in their respective positions of alignment. Each of the plates includes a portion of the cylindrical bore 126 and other passages. The plates 110 and 112 include passages 254 and 256, respectively, which communicate with the cylindrical bore 126. Similarly, plates 114 and 116 include, respectively, passages 258 and 260 which communicate with bore 126, the passages 258 and 260 being at right angles to the passages 254 and 256. The passages 254 through 260 all pass entirely through their respective plates. The plates 118 and 120 are substantially mirror images of each other and include, respectively, passages 262 and 264 which communicate with the bore 126 but which do not pass through their respective plates from face to face. The open side of the passage 262 faces plate 242 and the open side of passage 264 faces plate 122. The passages 262 and 264 communicate with a chamber 265 formed by recessed portions 266 in the plates 110 through 120 and an annular recess 268 formed in the housing 98 adjacent the plates 110 through 120. The chamber 265 communicates with the passage 108 and thereby to the fuel reservoir 48. (See FIG. 5.)

The collector plate 124 includes a first passage 268 which communicates with the supply port 246 and forms first and second supply tubes 270 and 272 which communicate with the passages 254 and 256 in the supply plates 110 and 112. Also in the collector plate 124 is a second passage 274 which communicates with the control port 248 and a pair of control tubes 276 and 278. Masking plate 122 is provided to isolate the passage 274 from the passage 264 in the reservoir plate 120. The control tubes 276 and 278 extend from the collector plate 124 through the masking plate 122 and the reservoir plate 120 to the passage 260 in the control plate 116, and from the control plate 116 through the supply plates 112 and 110 to the passage 258 in the control plate 114.

The flow paths of fluid through the servovalve 101 will now be described in connection with FIGS. 5 and 9. It will be noted that the lands 130, 132 and 134 of the spool 128 are aligned, respectively, with the plates 120, 112 and 114 when the servovalve is in a "neutral" position wherein fluid communication is prevented between the control plates and either the supply or reservoir plates. This neutral condition represents a static condition wherein fluid is flowing neither to nor from the control passage 106. Movement of the spool 128 in the direction of arrow 99 produces communication between the control plate and the supply plates; movement in the opposite direction will result in communication between the control plate and the reservoir plates. Since the bore 126 extends through the plates and the lands 130, 132 and 134 of the spool 128 are circular and of substantially the same cross section, their tight fit avoids fluid communication when they are in the neutral position. However, a slight movement from the neutral position will produce a relatively large flow passage because the annular opening which appears between the lands and the plates has a large flow area relative to the magnitude of the linear placement of the spool 128. For example, a displacement of ±0.011 inches from the neutral position has been found optimum for the herein described embodiment. That is, a small spool displacement gives a high gain in fluid flow.

When the spool 128 is shifted in the direction of the arrow 99, the land 130 continues to prevent communication between the control plate 116 and the reservoir plate 120 while the lands 132 and 134, respectively, permit communication between the supply plates 110 and 112 and the control plates 114 and 116. The land 134 continues to block communication between the control plate 114 and the reservoir plate 118. Fluid then flows from the supply passage 108 through the supply tube 270 to the passages 254 and 256 in the supply plates 110 and 112. This fluid then flows into the bore 126 and passes therefrom into the passages 258 and 260 of the control plates 114 and 116. From the passages in the control plates, the fluid flows through the control tubes 276 and 278 to the passage 274 in the collector plate. From the passage 274 the fluid passes through the control port 248 to the control passage 106.

If the spool then moves back to its neutral position, the fluid which passed into the passage 106 is trapped and will remain there. Movement of the spool further in the direction opposite the arrow 99 will result in the passages which were previously opened between the supply plates and the collector plates being closed and the previously closed passages between the supply plates and the reservoir plates being opened. When communication is permitted between the supply and reservoir plates, fluid enters the servovalve 101 through the control port 248 and passes to the passage 274 in the collector disc 124. From the passage 274 it travels along control passages 276 and 278 to the passages 260 and 258 in the control plates 116 and 114, respectively. From the passages 258 and 260 the fluid communicates with the bore 226 and, from the bore, with the passages 264 and 262 in the reservoir plates 120 and 118, respectively. From the passages 264 and 262 the fluid travels to the chamber 265 and, from the chamber 265, to the passage 108. Passage of fluid from the supply plates to the control plates applies equal and opposite forces on the spool 128 and thereby results in no net imbalance of dynamic forces. Similarly, passage of fluid from the control plates to the reservoir plates results in equal and opposite dynamic forces which do not result in unbalance.

Figure 10:
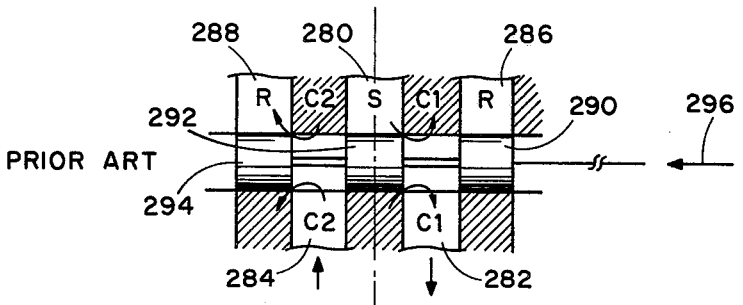
FIG. 10 is a schematic view of a prior art fourway valve.
Figure 11:
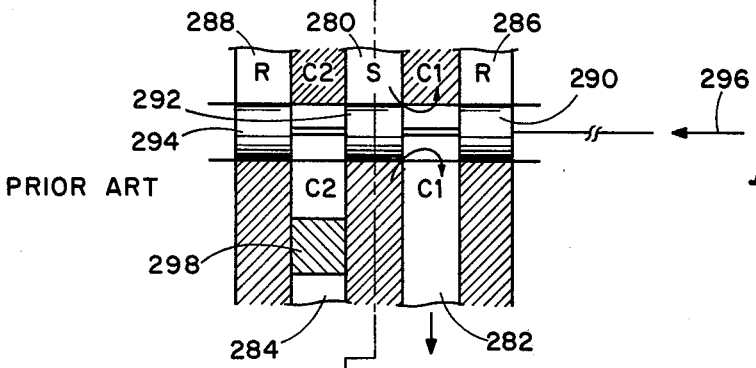
FIG. 11 is a schematic view of the prior are fourway valve of FIG. 10 modified to operate as a threeway valve.
Figure 12:
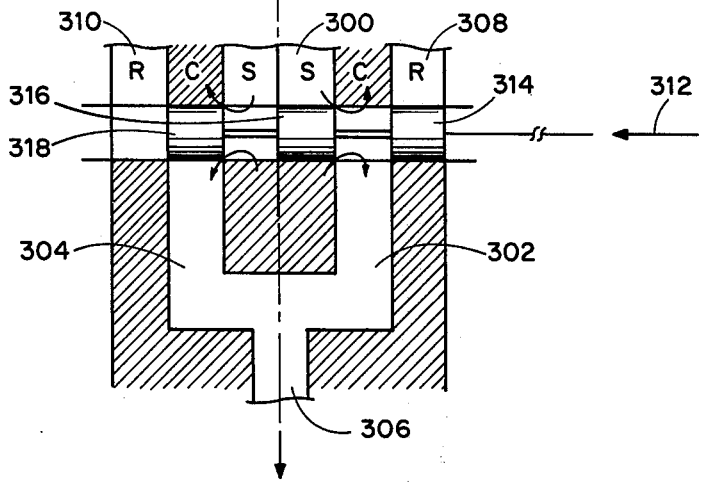
FIG. 12 is a schematic view showing a threeway valve constructed in accordance with the present invention.

Further explanation of the operation of the servovalve 101 will be given in connection with FIGS. 10 through 12. FIG. 10 shows a conventional 4-way valve system wherein a central supply 280 is flanked on either side by first and second control passages 282 and 284. The control passages are adjacent, respectively, to reservoir passages 286 and 288. Lands 290, 292 and 294 of a reciprocally mounted 3-land spool are respectively aligned with passages 286, 280 and 288. Thus, in a neutral position, communication between all passages is prevented. When the spool is moved in the direction of the arrow 296, communication is established between the supply 280 and the control 282 and between the control 284 and the reservoir 288. On the other hand, when the spool is moved in the direction opposite the arrow 296, communication is established between the supply 280 and the control 284 and between the reservoir 286 and the control 282. It can thus be seen that 4-way operation is established wherein the supply 280 communicates with either of two different control passages, each of the control passages having separate reservoir passages associated therewith. When communication between a supply passage and single control passage is desired, it has been frequently accomplished by utilizing the structure of FIG. 11 which is simply the structure of FIG. 10 with one of the control passages blocked by an appropriate means 298 so that communication takes place only between the supply passage 280, the control passage 282 and the reservoir passage 286. Thus, movement of the spool in the direction of the arrow 296 produces communication between the supply 280 and the control passage 282 while movement of the spool in the opposite direction produces communication between the control passage 282 and the reservoir passage 286.

Further, with reference to FIG. 10, it should be noted that fluid flow, such as that from the supply 280 to the control 282, produces a force which tends to oppose the motion of the spool and thereby produce a dynamically unstable condition. The flow of fluid from the control chamber 284 to the reservoir chamber 288 is in the direction of the movement of the spool and tends to produce a dynamically unstable condition. Since the two forces oppose each other, they cancel out and there is no resulting instability of the spool. On the other hand, when one of the control passages is blocked to provide 3-way operation, as illustrated in FIG. 11, there will be occasion when the flow of fluid will oppose the motion of the spool and produce a dynamically unstable condition. By reference to FIG. 12, showing a schematic of a servovalve similar to the servovalve 101, it will be appreciated that equal and opposite flows are produced under all conditions and thereby the 3-way operation of the servovalve will always be characterized by dynamic stability. The supply 300 is wide relative to the land 316 of the spool and, when the spool is moved in the direction of arrow 312, the supply can simultaneously communicate with both control passages 302 and 304. These control passages combine into a single control passage 306. Equal and opposite dynamic forces are produced by the fluid passage. When the spool is moved in the direction opposite the arrow 312, communication is established between the control passages 302 and 304 and the reservoir passages 308 and 310. Again, equal and opposite dynamic forces of the spool are produced.

Referring now to FIGS. 3 through 9, a description will be given of a vapor engine constructed in accordance with this invention. When the engine is operating, working fluid passes through the vapor cycle described above. The fuel pump 68 delivers fuel from the fuel reservoir 48 to the fuel inlet chamber 204 through the subassembly 202 and the fuel outlet chamber 206 to the nozzle 58 in the combustion chamber 40. The atomizing air blower 51 supplies air through the atomizing air control 46 and the line 64 to the nozzle 58 so that fuel will adequately be atomized in the burner 40. The fan 49 delivers an air supply through the conduit 66 and the control valve means 42 to the combustion chamber 40. In the combustion chamber, the fuel and air mix, burn and supply heat to the vapor generator 10. The volume of air admitted from the blower 49 to the burner and from the blower 51 to the nozzle 58 is controlled by the servomechanism 38. Inputs to the servomechanism 38 are designated 50', 50'', 52 and 54. Signal 50' is a high pressure signal from the upstream side of the signal orifice 26 which communicates with the pressure chamber 154 associated with the diaphragm means 144 in the operator means 102.

The signal 50'' is taken at the downstream side of the signal orifice and is low relative to the pressure of the signal 50'. The signal 50'' is in communication with pressure chamber 156 of the diaphragm means 144. The signals 50' and 50'' cooperate to urge the spool 128 in the direction of arrow 99 so as to establish communication between the supply and control plates with a force the intensity of which is a function of the magnitude of the pressure drop across the signal orifice 26. The signals 52 and 54 each communicate with the chamber 156 associated with the diaphragm means 146. Accordingly, they bias the spool 128 from movement in the direction opposite the arrow 99. Accordingly, at any given time, the position of the spool 128 will depend upon the bias applied thereto by the spring means 186 and 188 and the magnitude of the signals 50', 50'', 52 and 54. The signal 52 is proportional to the temperature of the engine working fluid at the boiler outlet. It may conveniently be provided by a temperature responsive device 53, such as a bi-metallic rod, variably opening a valve means 55 as a function of the boiler output temperature to provide a variable pressure signal from the atomizing air blower 51 to the servomechanism 38. The pressure of the signal 52 might typically vary from 3 psi to 15 psi depending on boiler outlet temperature. The signal 54 is a safety control and operates on an on-off basis. A temperature signal 57 is applied to a valve means 59. If the boiler heats to a predetermined level, the valve 59 will open and a signal 54 be transmitted to the pressure chamber 156 of the diaphragm means 146 which is strong enough (i.e., in excess of 15 psi) to completely nullify the signal 52 and the other control inputs to the servomechanism 38 and drive the spool valve 128 to its extreme position in the direction of arrow 99 so that maximum communication between the control plates 114 and 116 and the reservoir plates 118 and 120 is established. The valves 55 and 50 essentially apply a modulated pressure from the blower 51 to the servomechanism 38.

When the operating condition of the engine changes, the flow rate of the working fluid through the vapor generator will change. An increase in flow rate will result in increase in pressure drop across the signal orifice 26 and, oppositely, a decrease in the power output of the engine will result in a decrease of the pressure drop. When the pressure drop increases, the diaphragm means 144 is shifted in the direction of arrow 99, thus moving the spool 128 in the same direction. This established communication between the outlet of the pump 68, through the passage 108 and the passage 106, to the expansion chamber 222. The application of the relatively high pressure from the pump outlet to the expansion chamber causes the diaphragm 224 to move against the bias of the spring 226. This causes rotation of the gear sector 228 and the gear 230 so that the butterfly valve 214 opens to increase the flow of air to the conduit 218. Rotation of the valve 214 produces a corresponding rotation of the indicator means 232, the cams 84 and 86, and the transducer 234. The indicator means 232 is a visual indication of the butterfly valve position. The cam 84 causes the cam follower 190 to move in the direction opposite of the arrow 99. This increases the force of the spring means 188 upon the diaphragm means 140 and tends to urge the spool in the direction opposite the arrow 99 to reduce the magnitude of pressure applied to the expansible chamber 222. The cam 84 and the cam follower means 94 thus produce a feedback from the butterfly valve 214 to the servovalve 38. The feedback to the servovalve 38 provides positive control of the butterfly valve 214 position.

Simultaneously with the increased flow of air through the conduit 218 (66) to the burner 40, there is a corresponding increase of fuel supply and atomizing air through the nozzle 58. Rotation of the shaft 216 advances the cam 86 against the cam follower 96 of the fuel control 44. This advances the cam follower 96 in the direction of the arrow 99 and moves the member 203 of the fuel valve assembly 202 so that the slot 205 extends beyond the edge 207 of member 201 by an increased amount and thereby permits a larger flow of fuel from the inner chamber 204 through to the fuel outlet 206 to the line 60. The fuel passes through the element 74 which produces no change in the flow rate unless it exceeds a preset maximum. The fuel is then discharged into the combustion chamber 40 through the nozzle 58. The transducer 234 produces a signal proportional to the rotational displacement of the shaft 16 to increase the supply of atomizing air from the atomizing air blower 51 to the nozzle 58. The increased air, atomization of air and fuel to the combustion chamber results in increased heat output and thus in increased capacity of the vapor generator 10.

A reduction in demand on the engine will be accompanied by a corresponding reduction of the working fluid admitted to the expander 14. The resulting decrease in the pressure drop across the signal orifice 26 will reduce the pressure drop across the diaphragm means 144 and it will advance in the direction opposite the arrow 99. The spool 128 will be drawn in the same direction so as to constrict communication between the high pressure fluid supply and the expansible chamber 222. As this movement continues, the spool 128 will eventually move to a position wherein communication between the supply and the expansible chamber is cut off and communication is established between the expansible chamber and the lower pressure fluid reservoir 48 through the passage 108. This switch in fluid connection is accomplished as the spool passes the neutral position. Fluid from the expansible chamber 222 is expelled under the force of the spring 226 and passes along the passage 106 and through the servovalve 101 and the passage 108 to the low pressure reservoir 48. Contraction of the chamber 222 results in a movement of the gear sector 228 and the gear 230 which reduces the extent to which the butterfly valve 214 permits the passage of air through the conduit 218. Corresponding reductions are then carried out. The cam 84 retracts from the cam follower means 94 so that the force that the spring means 188 applies to the diaphragm means 140 is reduced. Thus, there is produced a feedback signal which tends to oppose the main input signal from the pressure drop across the diaphragm 144. Similarly, the cam 86 is drawn from the cam follower means 96 of the fuel control 44. The fuel pressure in the inlet chamber 204 expands the inlet chamber against the bias of the spring 208 and draws the member 203 back into the member 201 so that the opening produced by the slot 205 and the edge 207 is constricted and reduced fuel volume is fed to the outlet 206 and to the burner 40. The transducer 234 signals the atomization air control 46 to reduce the amount of air from the atomization air blower 51 which is permitted to pass along the line 64 to the nozzle 58. There is thus produced a corresponding reduction in air supply, fuel supply and atomization air supply which results in a lower combustion level in the burner 40 and therefore in reduced output of the vapor generator 10.

This invention has been described with reference to various preferred embodiments. It should be understood, however, that modifications may be made by those skilled in the art without departing from the scope of the invention.

I claim:

1. A vapor cycle engine comprising:

a. means for burning a combustible fuel and air mixture to product heat energy;

b. a vapor generator associated with said burning means for vaporizing a working fluid;

c. expander means for expanding working fluid vapor to produce work, the power output level of said expander being functionally related to the volume of working fluid vapor expanded;

d. means for condensing vaporized working fluid exhausted from said expander means;

e. means for transporting condensed working fluid to said vapor generator;

f. means for controlling admission of such fuel and air mixture to said burning means;

g. means for biasing said controlling means toward a predetermined setting, the biasing force being functionally related to the flow rate of working fluid through said vapor generator;

h. first means for communicating with a pressurized fluid supply;

i. second means for communicating with a fluid reservoir at a pressure level below the pressure of said fluid supply; and j. valve means associated with said first and second means establishing fluid communication between said fluid supply and said controlling means for providing a fluid pressure signal to overcome said biasing means and establishing fluid communication between said controlling means and said reservoir means for permitting said biasing means to overcome said fluid pressure signal.

2. A vapor cycle engine according to claim 1 wherein said valve means comprises:

a. means forming at least one fluid supply plate;

b. a pair of control plates positioned outwardly of said supply plate means, each control plate being contiguous with an opposite surface of the supply plate means;

c. a pair of reservoir plates positioned outwardly of said control plates, each of said reservoir plates being positioned contiguous with the remaining surface of one of said control plates;

d. means forming an elongated cavity extending through all of said plates;

e. means in said supply plate means forming fluid passages communicating with said elongated cavity and said first means;

f. means in each of said control plates forming fluid passages communicating with said elongated cavity and said controlling means;

g. means in each of said reservoir plates forming fluid passages communicating with said elongated cavity and said second means; and h. means movably mounted within said elongated cavity for blocking fluid communication both between said control plates and said elongated cavity and said reservoir plates and said elongated cavity when in a first position, for permitting fluid communication between said control plates and said supply plate means through said elongated cavity while preventing fluid communication between said reservoir plates and said elongated cavity when in a second position, and for permitting fluid communication between said control plates and said reservoir plates through said elongated cavity while preventing fluid communication between said supply plate means and said elongated cavity when in a third position.

* * * * *